US011081299B2

(12) United States Patent
Wu

(10) Patent No.: US 11,081,299 B2
(45) Date of Patent: Aug. 3, 2021

(54) SNAP ACTION SWITCH FOR GENERATING FEEDBACKS

(71) Applicant: Illinois Tool Works Inc., Glenview, IL (US)

(72) Inventor: Hopkin Wu, Kaohsiung (TW)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 15/975,324

(22) Filed: May 9, 2018

(65) Prior Publication Data

US 2019/0348234 A1 Nov. 14, 2019

(51) Int. Cl.
*H01H 13/28* (2006.01)
*H01H 13/18* (2006.01)

(52) U.S. Cl.
CPC ..... *H01H 13/28* (2013.01); *H01H 13/186* (2013.01)

(58) Field of Classification Search
CPC ..... H01H 2221/01; H01H 25/041; H01H 25/008; H01H 13/80; H01H 25/06; H01H 13/58; H01H 13/585; H01H 2223/00; H01H 2300/012; H01H 3/34; H01H 13/79; H01H 13/14; H01H 13/48; H01H 13/52; H01H 13/28; H01H 13/186
See application file for complete search history.

(56) References Cited

U.S. PATENT DOCUMENTS

| | | | | |
|---|---|---|---|---|
| 3,790,734 | A | 2/1974 | Raab | |
| 7,514,643 | B1 | 4/2009 | Tittle | |
| 2014/0262712 | A1* | 9/2014 | Chu | H01H 13/06 200/302.2 |
| 2015/0213975 | A1* | 7/2015 | Zheng | H01H 13/83 200/5 A |

OTHER PUBLICATIONS

Int'l Search Report and Written Opinion Appln No. PCT/US2019/018417 dated May 13, 2019.

* cited by examiner

*Primary Examiner* — Ahmed M Saeed
(74) *Attorney, Agent, or Firm* — McAndrews, Held & Malloy, Ltd.

(57) ABSTRACT

The snap action switch of the present disclosure may include a housing with a plurality of protruding blocks extending inwardly, a plunger disposed on the housing, a first elastic component coupled to the plunger for providing a force against the plunger, a cam located within the housing and being movable by the plunger, a rotor located within the housing and associated with the cam, and a second elastic component coupled to the rotor for providing a force against the rotor. When the cam moves to a first position, the rotor may rotate such that a lower surface of the cam engages with an upper surface of the rotor, and when the cam moves to a second position, the rotor may continue to rotate such that the upper surface of the rotor engages with a lower surface of at least one of the plurality of protruding blocks of the housing.

14 Claims, 7 Drawing Sheets

SNAP ACTION SWITCH FOR GENERATING FEEDBACKS

FIELD

The present disclosure is related to snap action switch for generating feedbacks.

BACKGROUND

Snap Action Switches are switch devices that can be turned on and off at a rapid speed. Only a little pressure or force is required for operating such devices. "Snap Action" occurs by the rapid movement of the spring-assisted moving contacts from one position to another, independent from the actuator speed. Usually, the conventional snap action switches are reed-based. Because the reed-based snap action switches are operated by very little pressure or force, the reed in such snap action switches can only provide very small feedbacks. Therefore, there is a need for improving the structures of the snap action switches.

SUMMARY

The present disclosure provides a snap action switch for generating a feedback when being pressed, and method for generating a feedback by a snap action switch. In some embodiments, the snap action switch may include a housing with a plurality of protruding blocks extending inwardly, a plunger disposed on the housing, a first elastic component coupled to the plunger for providing a force against the plunger, a cam located within the housing and being movable by the plunger, a rotor located within the housing and associated with the cam, and a second elastic component coupled to the rotor for providing a force against the rotor. When the cam moves to a first position, the rotor may rotate such that a lower surface of the cam engages with an upper surface of the rotor, and when the cam moves to a second position, the rotor may continue to rotate such that the upper surface of the rotor engages with a lower surface of at least one of the plurality of protruding blocks of the housing.

In another aspect, the snap action switch for generating a feedback when being pressed, may include a housing with a plurality of protruding blocks extending inwardly, a plunger disposed on the housing, a gasket coupled to the housing and the plunger, a cam located within the housing and being movable by the plunger, a rotor located within the housing and associated with the cam, a first elastic component coupled to the rotor for providing a force against the rotor, and a second elastic component coupled to the cam for providing a force against the cam. When the cam moves to a first position, the rotor may rotate such that a lower surface of the cam engages with an upper surface of the rotor, and when the cam moves to a second position, the rotor may continue to rotate such that the upper surface of the rotor engages with a lower surface of at least one of the plurality of protruding blocks of the housing.

Yet in another aspect, the method for generating a feedback by a snap action switch, may include moving a cam from a first position to a second position to rotate a rotor, such that an upper surface of the rotor engages with a lower surface of at least one of a plurality of protruding blocks of a housing, and restoring the cam back from the second position to the first position to rotate the rotor, such that a lower surface of the cam engages with the upper surface of the rotor. In one aspect, when the cam moves to the second position, a first electrical contact component coupled to the cam electrically contacts with the second electrical contact component coupled to the housing. In another aspect, when the cam moves to a third position between the first position and the second position, the first electrical contact component coupled to the cam electrically contacts with the second electrical contact component coupled to the housing. In yet another aspect, when the cam moves to a fourth position, the first electrical contact component coupled to the cam electrically contacts with the second electrical contact component coupled to the housing, and wherein the second position is between the first position and the fourth position.

The above and other aspects of the present disclosure are described in more details in the following contexts.

BRIEF DESCRIPTION OF THE DRAWINGS

So that the manner in which the above described features of the present disclosure can be understood, a more specific description of the disclosure, briefly summarized above, may be had by reference to embodiments, some of which are illustrated in the appended drawings. However, the appended drawings illustrate only exemplary embodiments of this disclosure. It is to be understood that the disclosure may admit to other equally effective embodiments, and therefore the appended drawings should not be considered as limiting the scope of the present disclosure.

To facilitate understanding, identical reference numerals have been used, where possible, to designate identical elements that are common in the figures. For the sake of clarity, the various embodiments shown in the figures are not necessarily drawn to scale and are illustrative representations.

DETAILED DESCRIPTION

Now the embodiments of the present disclosure will be described in details with reference to the drawings.

Figure 1:
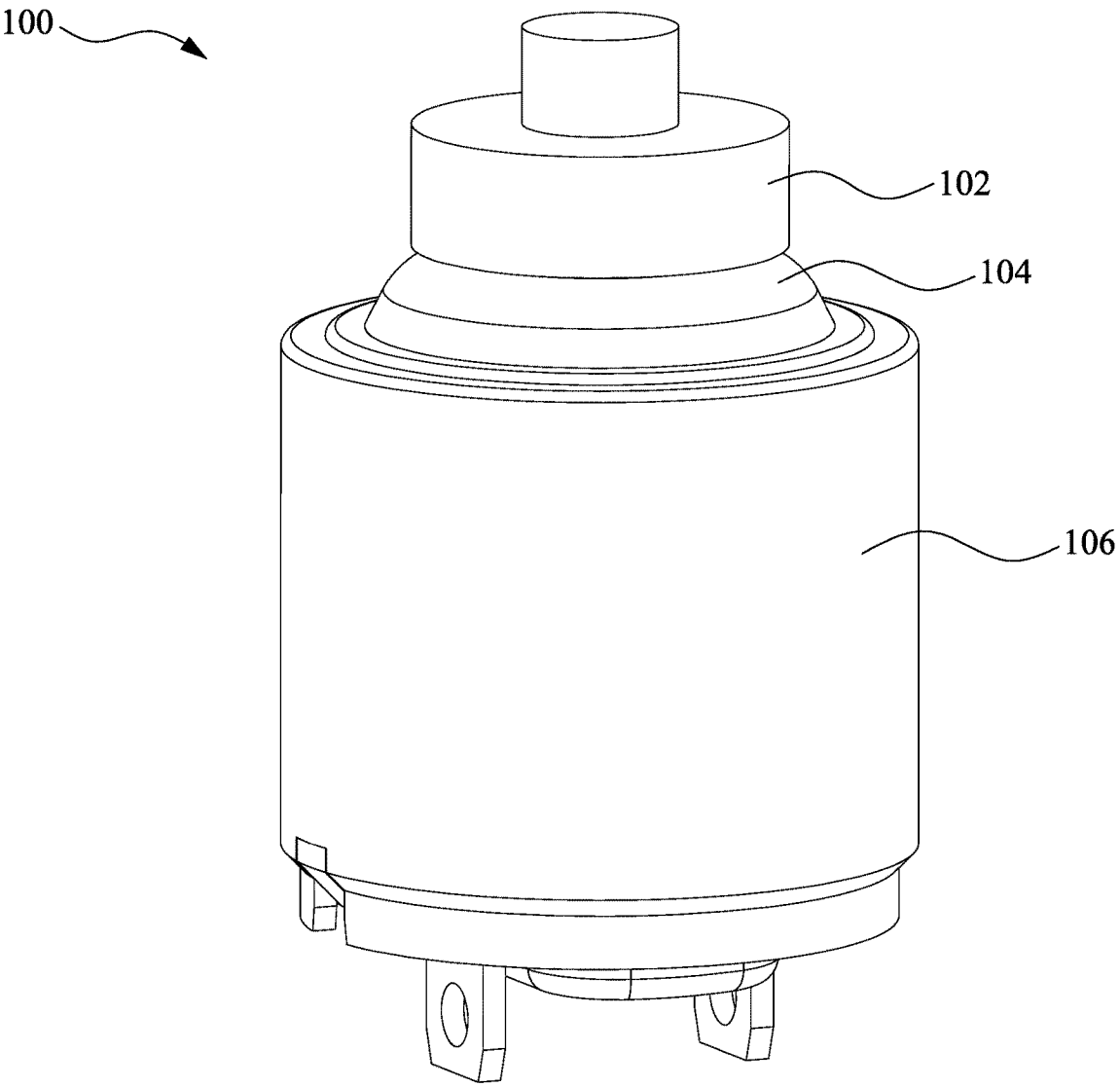
FIG. 1 illustrates a schematic view of a snap action switch according to an embodiment of the present disclosure.

FIG. 1 illustrates a schematic view of a snap action switch 100 according to an embodiment of the present disclosure. As shown in FIG. 1, the snap action switch 100 may include a housing 106, a plunger 102, and a first elastic component 104. Further with reference to FIG. 2, the schematic perspective view of the snap action switch 100 may further include a cam 108, a rotor 110, a second elastic component 112, and a spring 114.

In the embodiment as shown, the housing 106 may be a hollowed cylinder with surrounding inner wall forming an inner region. The inner wall of the housing may have a plurality of protruding blocks 107 extending inwardly, and each of the plurality of protruding blocks 107 has a sloped lower surface. The number of the protruding blocks 107 disposed on the inner wall of the housing 106 can be varied. Further, a hole is formed at the top of the housing and being communicated with the inner region, such that the lower end of the plunger 102 may pass through the hole and accommodate within the inner region. In some embodiments, the hole is designed to have a smaller diameter than the inner wall of the housing, such that at least a portion of the top wall remains surrounding the inner region of the housing.

The plunger 102 can be disposed on the housing 106 and is configured to be coupled with the cam 108 by extending the lower end through the hole at the top of the housing 106, and entering the inner region of the housing 106. The plunger 102 can be moved between a first position as an relaxed state and a second position as a compressed state. In some embodiments, the plunger 102 can be functioned as a button of the switch.

The cam 108 is located within the housing 106, and is movable by the plunger 102. The cam 108 is configured to have a plurality of protrusions 122 corresponding to the plurality of protruding blocks 107 of the housing 106. For example, the plurality of protrusions 122 of the cam 108 may interleave with the plurality of protruding blocks 107 of the housing 106. Therefore, the movement of the cam 108 will be defined by the protruding blocks 107 on the inner wall of the housing 106, and will move linearly along the center axis of the housing 106. Each of the plurality of protrusions 122 has a sloped lower surface, so as to engage with the rotor 110 (described in more details as below).

The diameter of the cam 108 may exceed the diameter of the hole at the top of the housing 106, such that the cam 108 can be secured within the inner region of the housing 106, and will not easily fall apart. It should be understood that although this embodiment shows eight protrusions 122 being disposed on the cam 108, other numbers or shapes of protrusions are also considered.

The rotor 110 is located within the housing 106 and associated with the cam 108. In the embodiment as shown, the rotor 110 is ring-shaped and has a plurality of teeth 124 extending upward from the peripheral of the rotor 110. The plurality of teeth 124 are disposed around the peripheral of the rotor 110. Each of the plurality of teeth 124 has a sloped upper surface, and the sloped upper surface of each of the plurality of teeth 124 may engage with the sloped lower surface of each of the plurality of protrusions 122 of the cam 108 when the plunger 102 is in the first position. It should be understood that although this embodiment shows eight teeth 124 being disposed on the rotor 110, other numbers or shapes of teeth are also considered.

Figure 2:
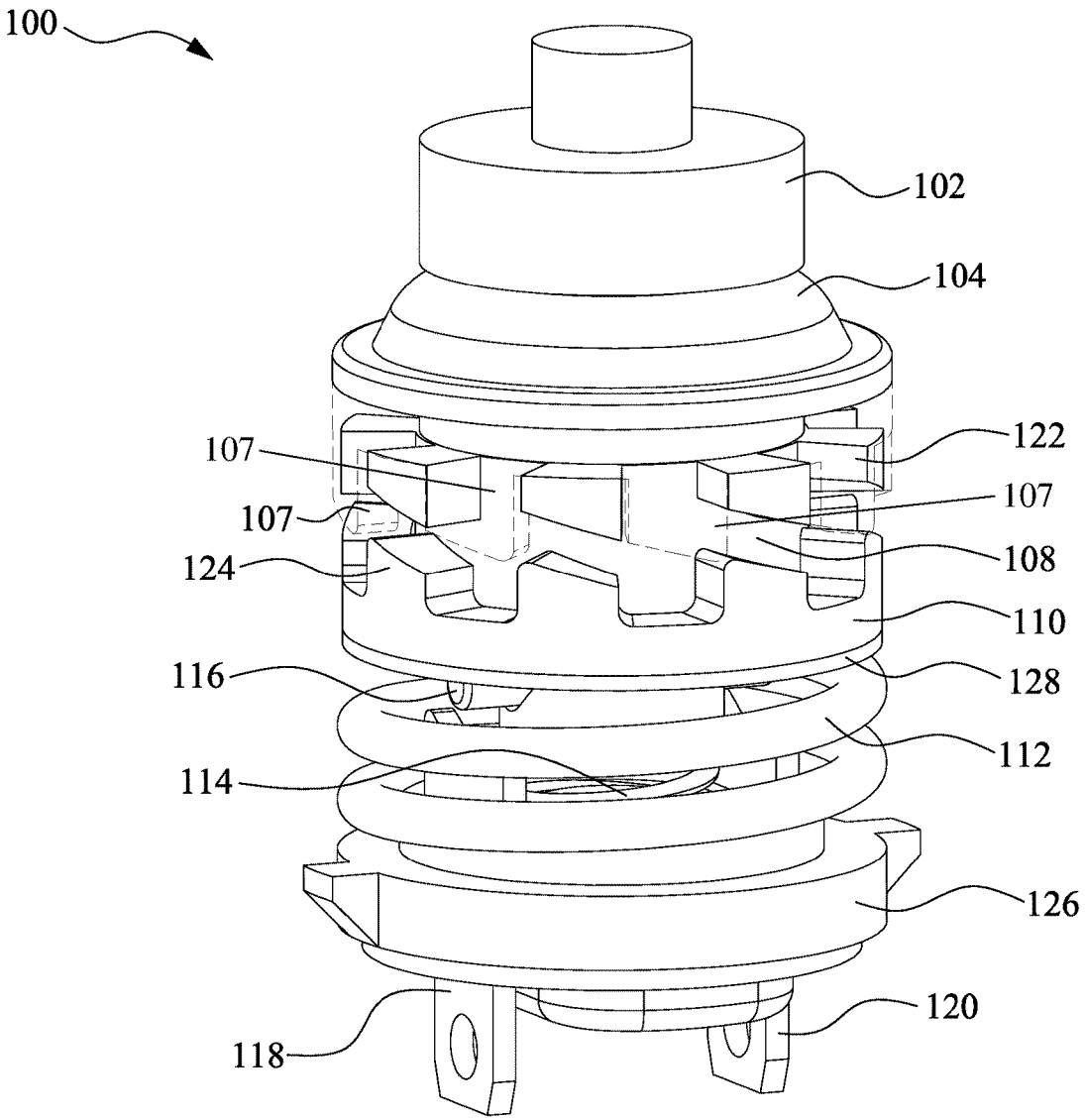
FIG. 2 illustrates a schematic perspective view of the snap action switch of FIG. 1.

In the embodiment as shown, the first elastic component 104 may be a dome. As shown in FIG. 2, one end of the first elastic component 104 is coupled to the plunger 102 and the other end of the first elastic component 104 is coupled to the top surface of the housing 106. The first elastic component 104 is elastic for providing a force against the plunger 102 to push the plunger 102 from the second position to the first position.

In the embodiment as shown, one end of the second elastic component 112 is coupled to the lower surface of the rotor 110 and the other end of the second elastic component 112 is coupled to the bottom 126 of the housing 106 within the inner region. In some embodiments, the rotor 110 may include a shim 128 coupled with the bottom surface of the rotor 110. The second elastic component 112 may provide a force against the rotor 110. In one embodiment, the second elastic component 112 is formed by a spring disposed between the rotor 110 and the housing 106.

Figure 3:
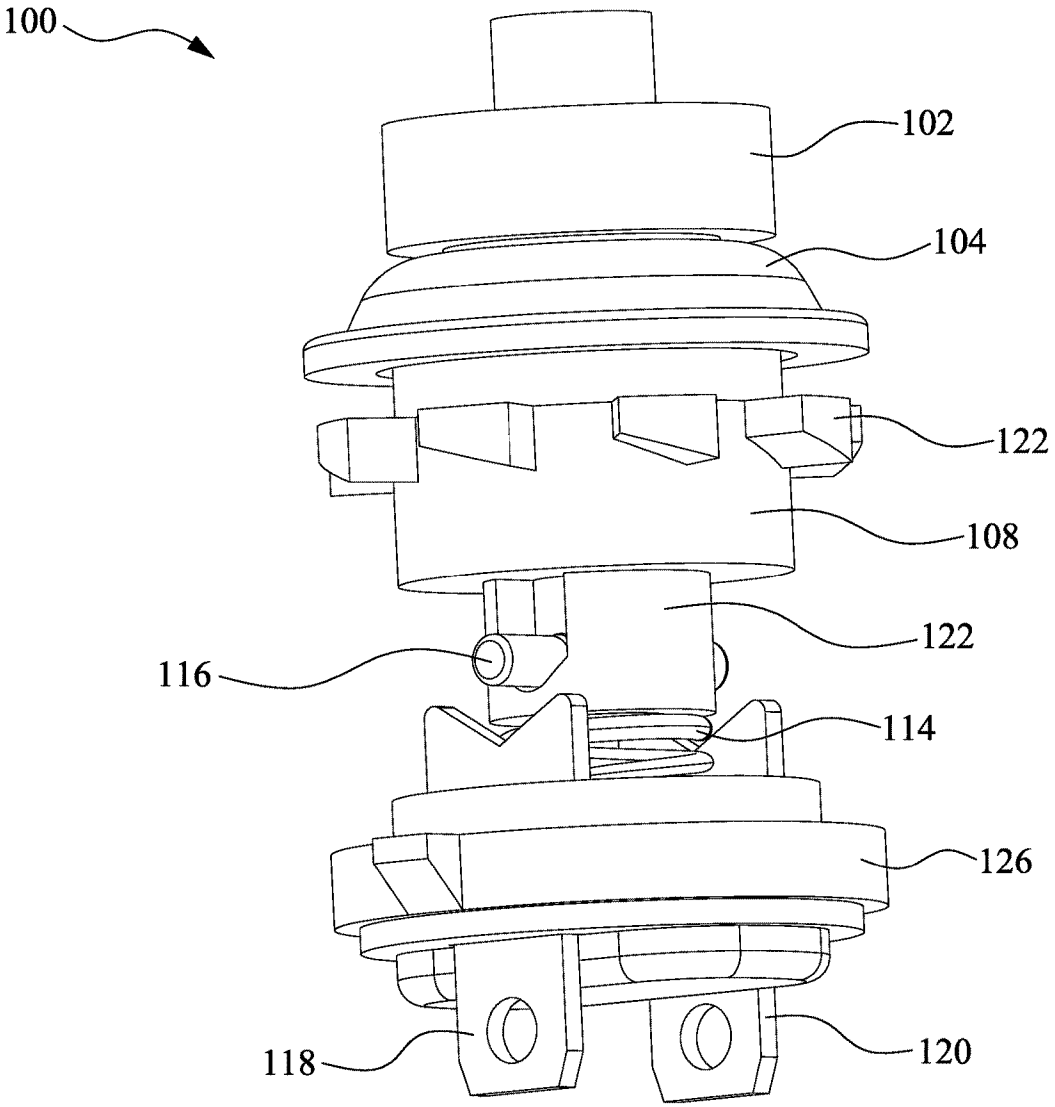
FIG. 3 illustrates another schematic perspective view of the snap action switch of FIG. 1.

With reference to FIG. 3, one end of the spring 114 is coupled to the lower end 122 of the cam 108 and the other end of the spring 114 is coupled to the bottom 126 of the housing 106. The spring 114 may provide a force against the cam 108.

When the plunger 102 is being pressed, the cam 108 moves downwardly away from the first position to the second position. Since the lower surface of each of the plurality of protrusions 122 of the cam 108 may engage with the upper surface of each of the plurality of teeth 124 of the rotor 110, the rotor 110 is also moved downward by the cam 108 to the second position. In some embodiments, when the sloped lower surface of each of the plurality of protrusions 122 of the cam 108 is aligned with the sloped lower surface of each of the plurality of protruding blocks 107 of the housing 106, the sloped upper surface of each of the plurality of the teeth 124 of the rotor 110 engaging with the sloped lower surface of each of the plurality of protrusions 122 of the cam 108 may slide to engage with the sloped lower surface of each of the plurality of protruding blocks 107 of the housing 106 by the second elastic component 112 to rotate the rotor 110 with an angle. At this time, a sound occurs and provides a feedback to the user. Simultaneously, as the rotor 110 is rotated, the user will no longer feel the restoration force provided by the second elastic component 112.

When the plunger 102 is relaxed from the second position, the cam 108 will move upwardly by the spring 114, and then the plunger 102 is moved upward by the cam 108 and the first elastic component 104. At this time, the sloped lower surface of each of the plurality of protrusions 122 of the cam 108 and the sloped lower surface of each of the plurality of protruding blocks 107 of the housing 106 will no longer aligned with each other. In some embodiments, when the sloped lower surface of each of the plurality of protrusions 122 of the cam 108 is aligned with the sloped lower surface of each of the plurality of protruding blocks 107 of the housing 106 again, the sloped upper surface of each of the plurality of the teeth 124 of the rotor 110 engaging with the sloped lower surface of each of the plurality of protruding blocks 107 of the housing 106 may slide to engage with the sloped lower surface of each of the plurality of protrusions 122 of the cam 108, to rotate the rotor with an angle. At that time, another sound will occur, and the plunger 102 returns back to the first position.

With reference to FIG. 3, the snap action switch 100 may further include a contact bar 116 as a first electrical contact component and two terminals 118, 120 as a second electrical contact component. The contact bar 116 and two terminals 118, 120 are conductors of electricity. In the embodiment as shown, the lower end 122 of the cam 108 passes through the ring-shaped rotor 110, and the contact bar 116 is disposed on the lower end 122 of the cam 108 laterally below the rotor 110. The two terminals 118, 120 may penetrate through the bottom 126 of the housing 106. Thus, the two terminals 118, 120 are partly inside the inner region of the housing 106, and partly outside the housing 106. When the plunger 102 is pressed from the first position toward the second position, the cam 108 is moved by the plunger 102, and then the contact bar 116 may electrically contact with the two terminals 118, 120 to form electrical connection when the rotor 110 is rotated.

In some embodiments, the lower end 122 of the cam 108 may be a hollowed cylinder surrounding an inner region. The lower end 122 of the cam 108 may be configured to have two elongated slots at two sides opposing to each other. The contact bar 116 may pass through the two elongated slots and move along the two elongated slots relative to the lower end 122 of the cam 108. The snap action switch 100 may further include an internal spring (not shown). The internal spring is disposed within the inner region of the lower 122 end of the cam 108, and coupled to the lower end 122 of the cam 108 and the contact bar 116 to provide a force against the contact bar 116 to push the contact bar 116 to one end of the two elongated slots. In some embodiments, the lengths of the two elongated slots are variable.

In some embodiments, the contact bar 116 may electrically contact with the two terminals 118, 120 to form electrical connection after the plunger 102 is moved and before the rotor 110 is rotated. That is, when the cam 108 moves to a third position between the first position and the second position, the contact bar 116 may electrically contact with the two terminals 118, 120 to form electrical connection.

In another embodiment, the contact bar 116 may electrically contact with the two terminals 118, 120 to form electrical connection after the rotor 110 is rotated. That is, when the cam 108 moves to a fourth position, the contact bar 116 may electrically contact with the two terminals 118, 120 to form electrical connection. In addition, in this embodiment, the second position can be located between the first position and the fourth position.

Figure 4:
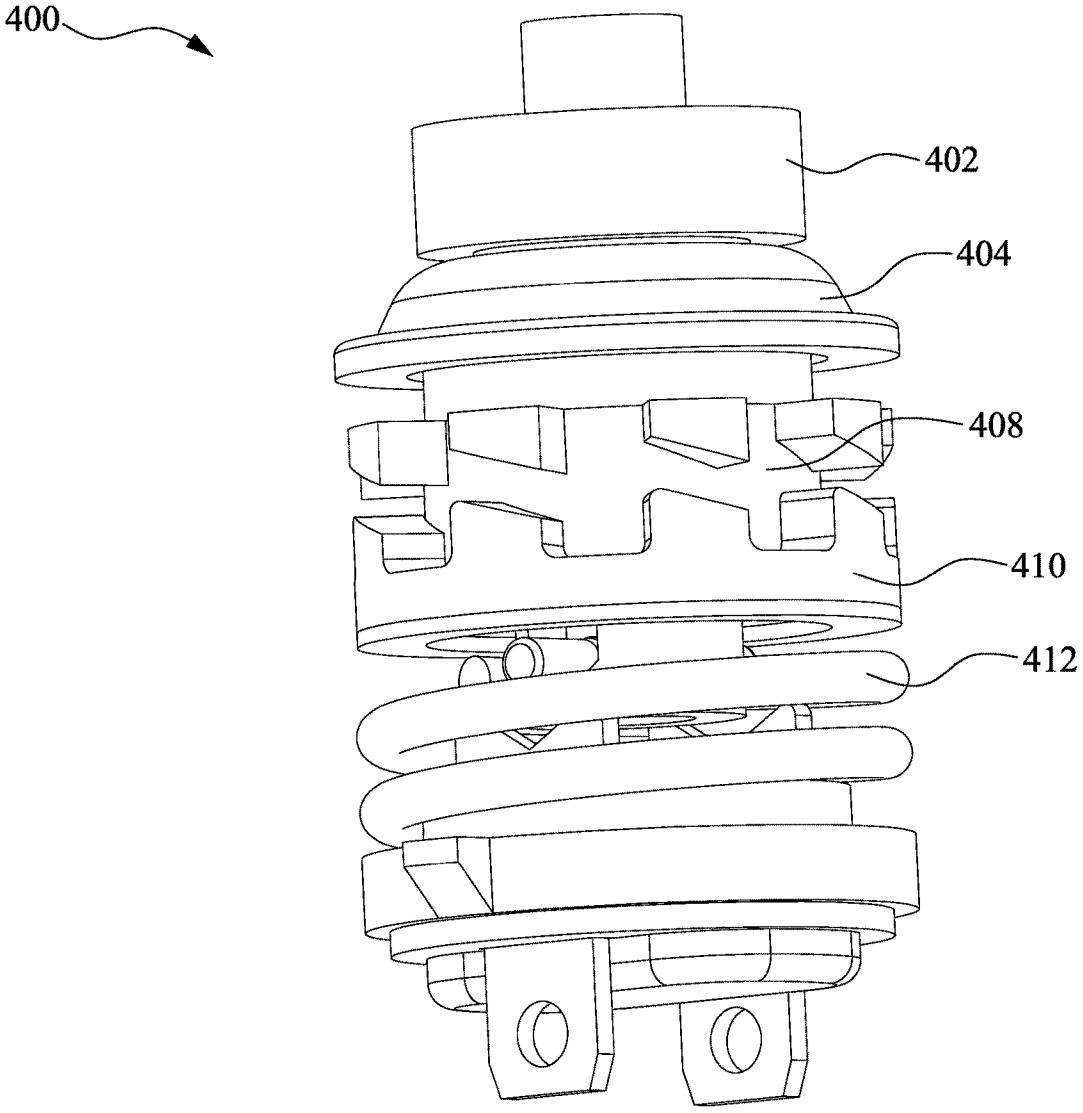
FIG. 4 illustrates a schematic perspective view of a snap action switch according to another embodiment of the present disclosure.

FIG. 4 illustrates a schematic perspective view of a snap action 400 switch according to another embodiment of the present disclosure. In the embodiment as shown, the structure of the snap action switch 400 of FIG. 4 is similar to the structure of the snap action switch 100 of FIG. 2. The snap action switch 400 of FIG. 4 may include a housing, a plunger 402, a dome 404, a cam 408, a rotor 410, and an elastic component 412. In this embodiment, when the plunger 402 is relaxed in the first position, the dome 404 is able to provide a force against the plunger 402.

Figure 5:
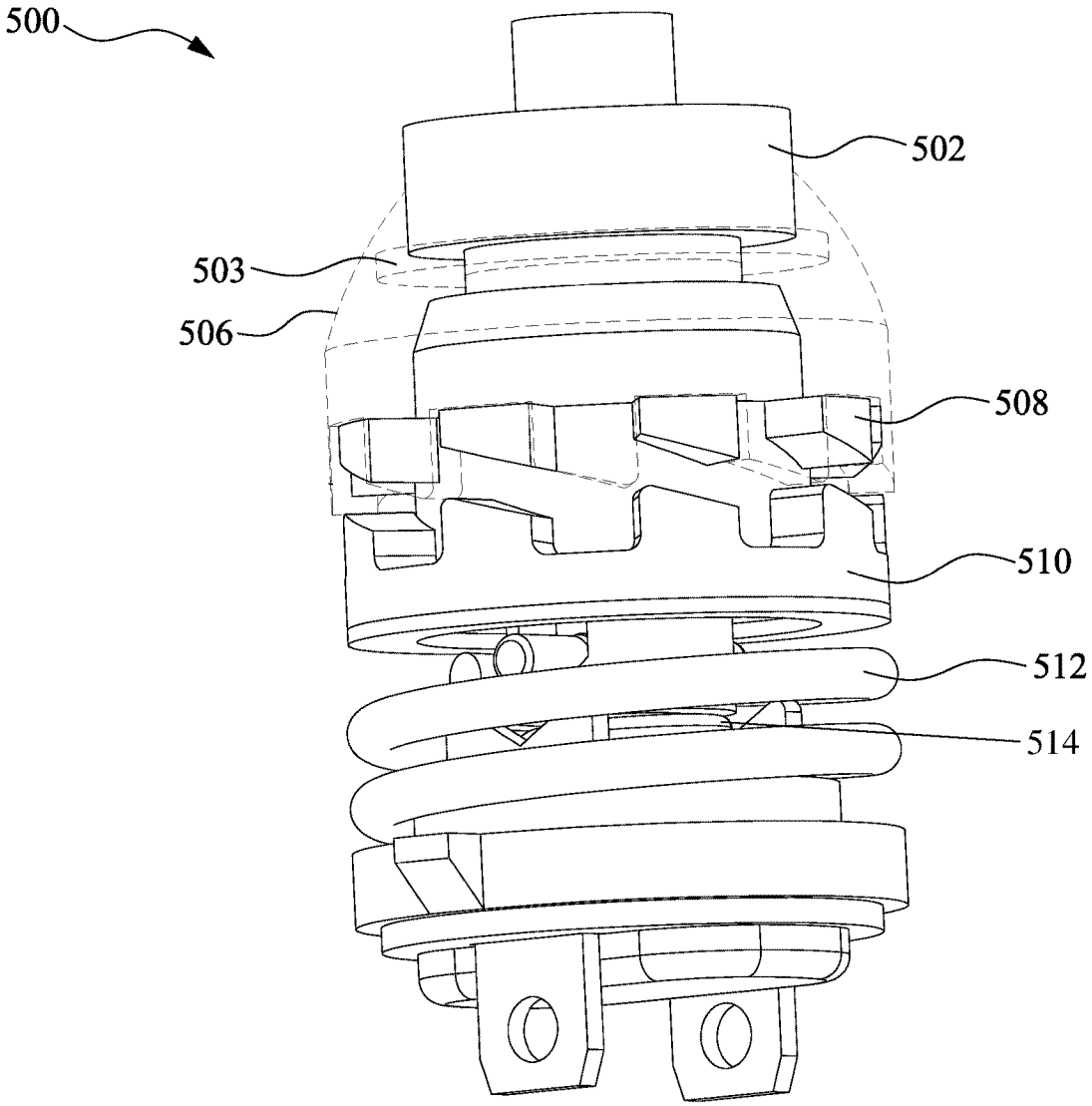
FIG. 5 illustrates a schematic perspective view of a snap action switch according to yet another embodiment of the present disclosure.
Figure 6:
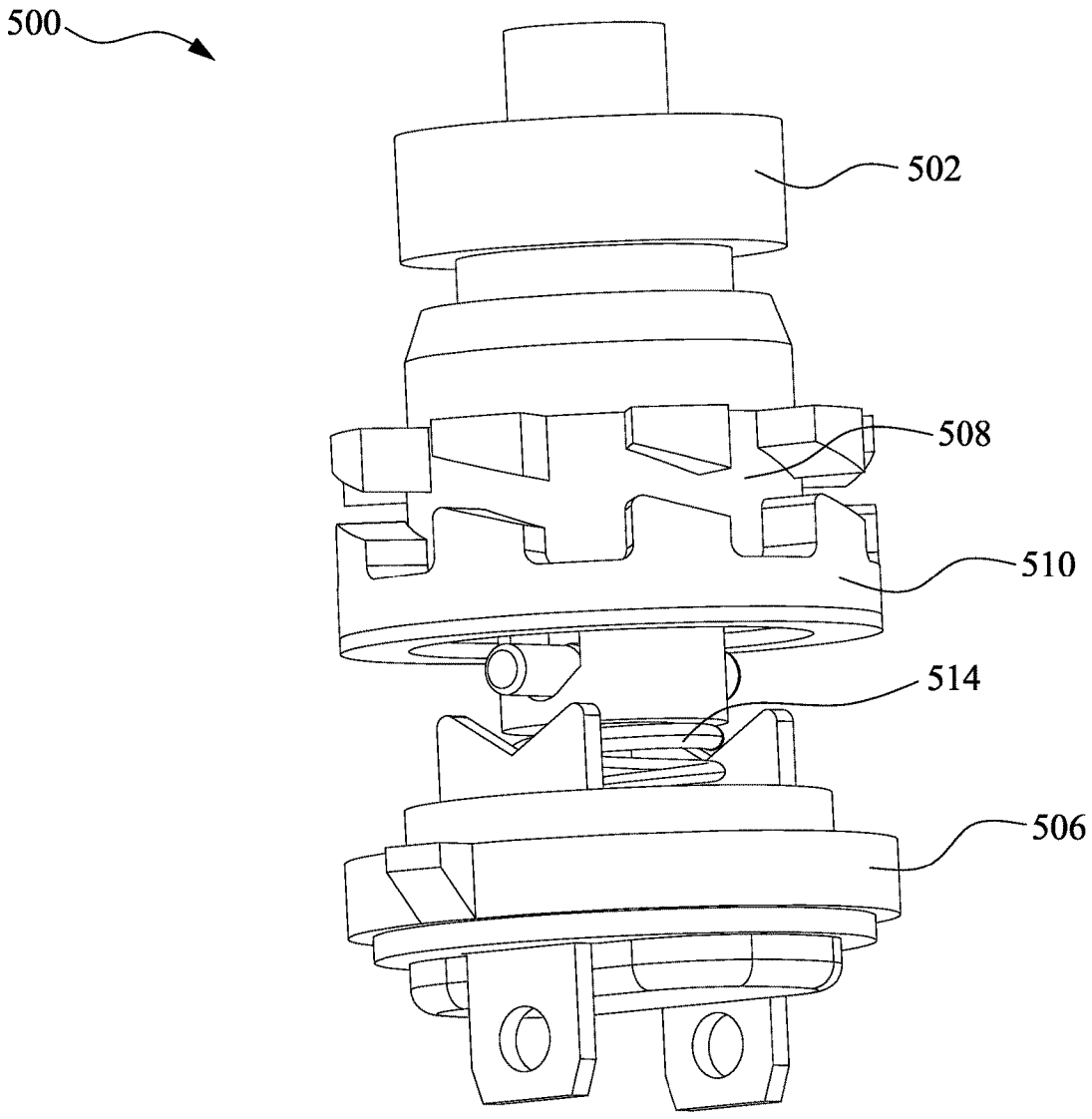
FIG. 6 illustrates a schematic perspective view of the snap action switch of FIG. 5.

FIG. 5 illustrates a schematic perspective view of a snap action 500 switch according to yet another embodiment of the present disclosure, and FIG. 6 illustrates a schematic perspective view of the snap action switch 500 of FIG. 5. In the embodiment as shown, the structure of the snap action switch 500 of FIG. 5 is similar to the structure of the snap action switch 100 of FIG. 2. The snap action switch 500 of FIGS. 5 and 6 may include a housing, a plunger 502, a cam 508, a rotor 510, an elastic component 512, and a spring 514. In this embodiment, the spring 514 is disposed under the rotor 510 and connects between the cam 508 and the bottom of the housing. As such, when the plunger 502 is relaxed in the first position, the spring 514 provides a force against the cam 508, which in turn pushes the plunger 502 upwardly to hold the plunger 502 in the first position. In some embodiments, the snap action switch 500 may further include a gasket 503. In one embodiment, one end of the gasket 503 is coupled to the plunger 502 and the other end of the gasket 503 is coupled to the top surface 506 of the housing. The use of the gasket 503 is able to prevent water from flowing into the inner region of the housing.

Figure 7:
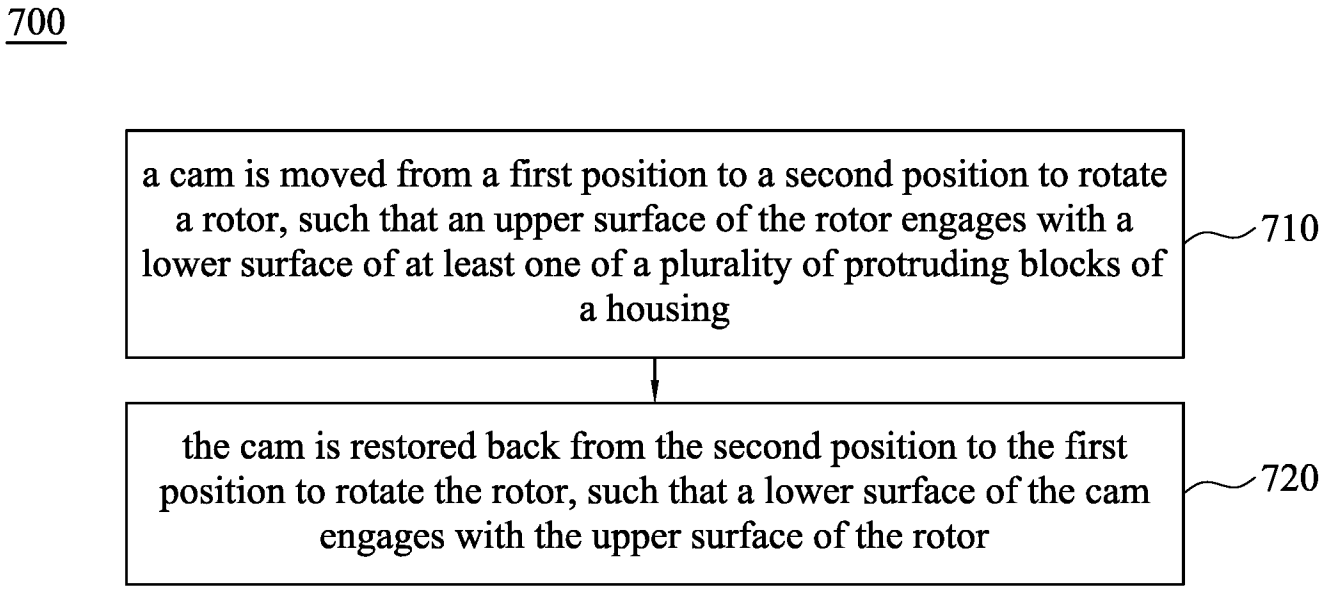
FIG. 7 is a flow chart of a method for generating a feedback by a snap action switch according to an embodiment of the present disclosure.

FIG. 7 is a flow chart of a method 700 for generating a feedback by a snap action switch according to an embodiment of the present disclosure. In step 710, a cam is moved from a first position to a second position to rotate a rotor, such that an upper surface of the rotor engages with a lower surface of at least one of a plurality of protruding blocks 107 of a housing 106. In this step, the rotor is able to provide a feedback to the user when being rotated by the cam at the second position. In step 720, the cam is restored back from the second position to the first position to rotate the rotor, such that a lower surface of the cam engages with the upper surface of the rotor.

Exemplary embodiments of the present disclosure have been described with reference to the drawings. However, it will be apparent to those skilled in the art that various modifications and alterations can be made to the present disclosure without departing from the scope and spirit as defined by the appended claims.

What is claimed is:

1. A snap action switch for generating a feedback when being pressed, comprising:

a housing with a plurality of protruding blocks extending inwardly;

a plunger disposed on the housing;

a first elastic component coupled between the housing and the plunger for providing a first force against the plunger;

a first electrical contact component and a second electrical contact component;

a cam located within the housing and being movable by the plunger, wherein the first electrical contact component is disposed on the cam, and the second electrical contact component is coupled to the housing;

a rotor disposed in the housing and associated with the cam; and a second elastic component coupled to the rotor for providing a second force against the rotor;

wherein when the cam moves from an unpressed position to a partially pressed position, the rotor rotates such that a lower surface of the cam engages with an upper surface of the rotor, and when the cam moves from the partially pressed position to a fully pressed position, the rotor continues to rotate such that the upper surface of the rotor engages with a lower surface of at least one of the plurality of protruding blocks of the housing; and wherein the first electrical contact component is spaced from the second electrical contact component at all times when the cam is in the unpressed position, and the first electrical contact component contacts the second electrical contact component in at least one of the partially pressed position and the fully pressed position.

2. The snap action switch of claim 1, wherein the rotor comprises a plurality of teeth.

3. The snap action switch of claim 2, wherein the lower surface of the cam engages with an upper surface of at least one of the plurality of teeth of the rotor when the cam moves to the partially pressed position, and wherein the upper surface of the at least one of the plurality of teeth of the rotor engages with the lower surface of the at least one of the plurality of protruding blocks of the housing when the cam moves to the fully pressed position.

4. The snap action switch of claim 1, further comprising a spring coupled to the cam for providing a force against the cam.

5. The snap action switch of claim 1, wherein the second elastic component is a spring.

6. The snap action switch of claim 1, wherein when the cam moves to the fully pressed position, the first electrical contact component electrically contacts with the second electrical contact component.

7. The snap action switch of claim 1, wherein when the cam moves to a third position between the partially pressed position and the fully pressed position, the first electrical contact component electrically contacts with the second electrical contact component.

8. The snap action switch of claim 1, wherein the upper surface of the rotor disengages from the lower surface of the cam when the upper surface of the rotor is engaged with the lower surface of the protruding block.

9. The snap action switch of claim 1, wherein the second elastic component and the rotor apply the second force to the cam and the plunger while the upper surface of the rotor is engaged with the lower surface of the cam between the partially pressed position and the fully pressed position, and the upper surface of the rotor disengages from the lower surface of the cam to remove the second force from the rotor prior to or at the fully pressed position.

10. A snap action switch for generating a feedback when being pressed, comprising:

a housing with a plurality of protruding blocks extending inwardly;

a plunger disposed on the housing;

a gasket coupled to the housing and the plunger;

a cam located within the housing and being movable by the plunger;

a rotor disposed in the housing and associated with the cam;

a first electrical contact component and a second electrical contact component, wherein the first electrical contact component is disposed on the cam, and the second electrical contact component coupled to the housing;

a first elastic component coupled to the rotor for providing a force against the rotor; and a second elastic component coupled to the cam for providing a force against the cam;

wherein when the cam moves to from an unpressed position a partially pressed position, the rotor rotates such that a lower surface of the cam engages with an upper surface of the rotor, and when the cam moves from the partially pressed position to a fully pressed, the rotor continues to rotate such that the upper surface of the rotor engages with a lower surface of at least one of the plurality of protruding blocks of the housing; and wherein the first electrical contact component is spaced from the second electrical contact component at all times when the cam is in the unpressed position, and the first electrical contact component contacts the second electrical contact component in at least one of the partially pressed position and the fully pressed position.

11. The snap action switch of claim 10, wherein the rotor comprises a plurality of teeth.

12. The snap action switch of claim 11, wherein the lower surface of the cam engages with an upper surface of at least one of the plurality of teeth of the rotor when the cam moves to the partially pressed position, and wherein the upper surface of the at least one of the plurality of teeth of the rotor engages with the lower surface of the at least one of the plurality of protruding blocks of the housing when the cam moves to the fully pressed position.

13. The snap action switch of claim 10, wherein when the cam moves to the fully pressed position, the first electrical contact component electrically contacts with the second electrical contact component.

14. The snap action switch of claim 10, wherein when the cam moves to a third position between the partially pressed position and the fully pressed position, the first electrical contact component electrically contacts with the second electrical contact component.

* * * * *